US007701150B2

(12) United States Patent
Nguyen et al.

(10) Patent No.: US 7,701,150 B2
(45) Date of Patent: Apr. 20, 2010

(54) CURRENT SHAPING OF AN LED SIGNAL FOR INTERFACING WITH TRAFFIC CONTROL EQUIPMENT

(75) Inventors: Khoa Nguyen, Montreal (CA); Vinh Nguyen, Lachine (CA); Reynald Gelinas, Ile-Perrot (CA)

(73) Assignee: Lumination LLC, Cleveland, OH (US)

( * ) Notice: Subject to any disclaimer, the term of this patent is extended or adjusted under 35 U.S.C. 154(b) by 188 days.

(21) Appl. No.: 12/006,124

(22) Filed: Dec. 31, 2007

(65) Prior Publication Data

US 2009/0167210 A1 Jul. 2, 2009

(51) Int. Cl.
*H05B 37/02* (2006.01)

(52) U.S. Cl. ..... 315/307; 315/224; 315/247

(58) Field of Classification Search ..... 315/224, 315/246–247, 268, 271, 291, 302, 307–308, 315/351

See application file for complete search history.

(56) References Cited

U.S. PATENT DOCUMENTS 5,811,941 A * 9/1998 Barton ..... 315/307
6,144,812 A * 11/2000 Ueno ..... 399/12
6,597,131 B2 * 7/2003 Ito et al. ..... 315/308
7,394,209 B2 * 7/2008 Lin et al. ..... 315/247
2003/0160575 A1 * 8/2003 Weedon ..... 315/291
2005/0062435 A1 * 3/2005 Namba et al. ..... 315/224
2006/0255750 A1 * 11/2006 Hotta et al. ..... 315/291

* cited by examiner

*Primary Examiner*—David Hung Vu
*Assistant Examiner*—Tung X Le
(74) *Attorney, Agent, or Firm*—Fay Sharpe LLP

(57) ABSTRACT

A system creates a desired current level within a traffic signal. A power supply unit receives an external power signal and transforms the power signal to a lamp current. A pulse generator monitors the value of the lamp current and automatically adjust the power usage of the current sink circuit to maintained a predefined current amplitude. A current pulser generates square current pulses at a frequency based at least in part on the frequency of the lamp current. A current sink superimposes the rectangular current pulse onto the lamp current and outputs a combined power signal to the alternating current power line.

20 Claims, 5 Drawing Sheets

CURRENT SHAPING OF AN LED SIGNAL FOR INTERFACING WITH TRAFFIC CONTROL EQUIPMENT

BACKGROUND

The present exemplary embodiments relate to traffic signals. It finds particular application in conjunction with utilizing light emitting diodes with traffic signals. One particular application for such an LED traffic signal is interfacing with control systems previously utilized with incandescent traffic signals, and it will be described with particular reference thereto. However, it is to be appreciated that the present exemplary embodiment is also amenable to other like applications.

Traffic signals are employed to regulate motorists and pedestrians via various commands. These commands are provided by various illuminated elements with particular colors and/or shapes that are each associated with an instruction. Elements are conventionally illuminated via incandescent bulbs which use heat caused by an electrical current to emit light. When electrical current passes through a filament (e.g., tungsten), it causes the filament to heat to the point that it glows and gives off light. Such illumination can be covered with a colored lens and/or template to provide a meaningful instruction that can be viewed in a variety of external lighting conditions.

The filament is a resistive element in the incandescent bulb circuit. The amount of current drawn by the filament is proportional to its impedance. This impedance value increases as the temperature of the filament increases. Thus, a conventional lamp has a larger initial current draw which drops in proportion to the increase in the filament impedance. This variation in current draw is known and a predetermined range can be utilized to monitor the lamp operation. As such, a lamp failure condition can be identified based on the amount of current drawn by the filament. In one example, the filament fails (e.g., breaks) causing the impedance approaches an infinite value and the current value decreases to almost zero. If the current drawn is outside of the predetermined range, a responsive action can be initiated by a current monitor or other control system.

Current monitors detect the failure of traffic signal lamps by monitoring the current drawn by the lamps. A current lower than a predetermined threshold is interpreted as a lamp failure by the current monitor. LED signals draw significantly less current than traditional incandescent signals for which current monitors were originally developed. Some current monitors therefore interpret functional LED signals as having failed. LED traffic signals require a dedicated electronics circuitry to prevent current monitors from detecting current loss in installations where such monitors are used.

Unlike the incandescent-based lamps, which use a single large bulb, the LED-based lamps consist of an array of LED elements, arranged in various patterns. When viewed from a distance, the array appears as a continuous light source. LED-based lamps have numerous advantages over incandescent lamps, such as greater energy efficiency and a longer lifetime between replacements than conventional signals. Some of the longer lifetime results since a plurality of LEDs are employed, wherein a light can be utilized even if some of the LEDs in the array have failed.

What are needed are systems and methods to utilize LED signals that seamlessly interface with conventional traffic signal monitoring systems.

BRIEF DESCRIPTION

In one aspect, a system creates a desired current level within a traffic signal. A power supply unit receives an external power signal and transforms the power signal to a lamp current. The pulse generator generates current pulses at a predefined amplitude that is compatible with the current monitor. The pulse generator includes an under voltage circuit that includes a peak detector and one or more voltage comparators for monitoring the external power signal to determine if the voltage of the external power signal is below a predetermined threshold. A frequency divider consists of a voltage divider network and a counter which divides a clock value and outputs a decade counter signal, the clock value is the frequency of the external power signal. A current pulser generates rectangular current pulses at a frequency based at least in part on the counter signal. A current sink superimposes the rectangular current pulse onto the lamp current and regulates the combined currents at a predefined value, wherein the clock of the frequency divider circuit, the current pulser and the current sink are disabled when the line voltage is below a predetermined threshold.

In another aspect, a pulse generator system superimposes a current pulse onto a lamp current signal within a non-incandescent traffic signal. An under voltage circuit receives an input voltage from the PSU, the under voltage circuit includes a peak detector and one or more voltage comparators to monitor the external power signal to determine if the voltage of the lamp current signal is below a predetermined threshold. A frequency divider includes a voltage divider network that divides a clock value, wherein the clock value is the frequency of the lamp current signal. A counter receives the clock value from the voltage divider network and outputs a counter signal, which is one tenth of the frequency of the clock value. A current pulser generates rectangular current pulses at a frequency based at least in part on the counter signal. A current sink superimposes the rectangular current pulse onto the lamp current signal and outputs a combined power signal to the current monitor. The line voltage and the current pulses are synchronized by the under voltage detection circuitry, when the lamp current signal voltage rises above the under voltage predetermined threshold, the clock input is released and the frequency divider circuit begins to operate.

In yet another aspect, a method is employed to modify power delivered to an LED traffic signal illumination element. An alternating current (AC) power signal is received from an external source. The AC power signal is transformed to a direct current (DC) signal. A lamp current is generated from the DC signal to power to an LED illumination element and a rectangular current pulse is generated at a predefined time and for a predefined interval. The rectangular current pulse is superimposed onto the lamp current to create a combined current signal to interface to the current monitor.

DETAILED DESCRIPTION

In describing the various embodiments of the backlighting system, like elements of each embodiment are described through the use of the same or similar reference numbers.

A circuit can be employed with a traffic signal whose function it is to draw additional current on the input line at specific timing. The result is a sinusoidal waveform of the actual current drawn by the signal wherein a plurality of pulses is superimposed on the sinusoid. In this manner, a current monitor does not interpret a functional LED signal as having failed although the current drawn is outside of a predetermined current threshold.

Figure 1:
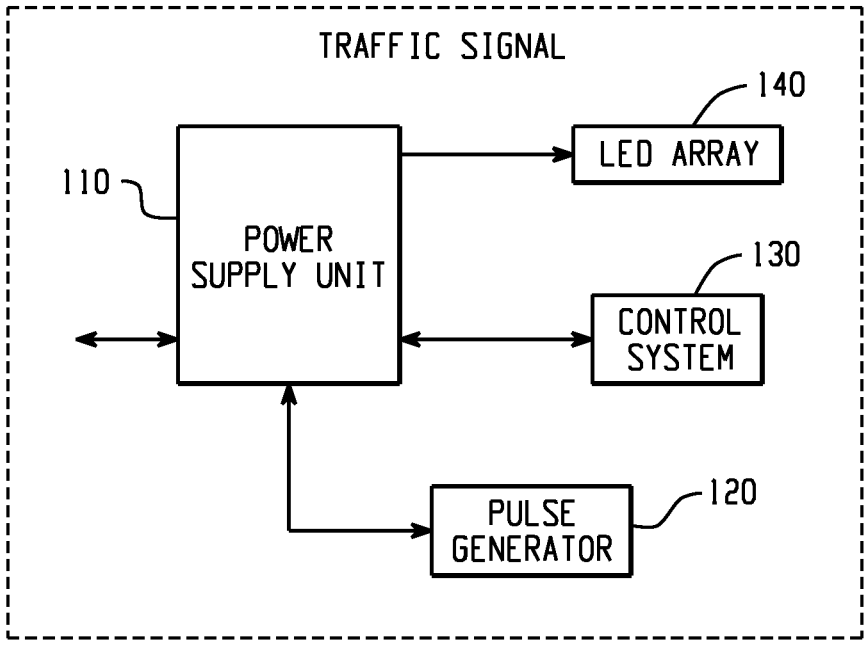
FIG. 1 illustrates a traffic signal that utilizes a pulse generator with an LED array, in accordance with an aspect of the subject invention.

FIG. 1 illustrates a traffic signal 100 in accordance with a subject embodiment. The traffic signal 100 includes a power supply unit 110, a pulse generator 120, a control system 130, and an LED array 140. The traffic signal 100 receives power from an outside source and converts the received power to usable levels to drive the LED array 140. If the power of the LED array 140 is outside a predetermined range, the control system 130 can initiate a corrective measure. The pulse generator 120 superimposes current pulses onto the lamp current to ensure proper interface with the current monitor.

The PSU 110 receives power from an outside line, such as a public utility for example. Generally, this power is an alternating current (AC) signal that is converted into a direct current (DC) signal for consumption by one or more illuminating elements. In one approach, the PSU 110 is a switching power supply which converts outside current (e.g., at 60 Hz) to a much higher frequency. This conversion enables a transformer (not shown) to perform a voltage step-down from the line power (e.g., 110V, 220V, etc.) to a desired voltage. In this manner, the power supply unit (PSU) 110 generates a DC current that drives the LED array 140.

LED traffic lamps are typically employed to retrofit existing incandescent traffic signals. These incandescent signals are generally configured with a power supply, a current monitor and one or more incandescent light bulbs. In conventional signals, the incandescent bulb can draw ten times more current than an LED array. In one example, an incandescent lamp draws 300 mA wherein an LED draws 20 mA. Current monitors that are configured for incandescent bulbs can incorrectly interpret this significant difference in current draw with lamp failure.

Accordingly, to compensate for this disparity in power consumption, various conventional techniques have been employed. In one approach, a dummy load is attached to an LED traffic signal to cause a larger current draw from a power supply unit. The size of the dummy load can be configured relative to the amount of current drawn by the LEDs in a signal. Thus, the combination of the LEDs and the dummy load can draw substantially the same current as an incandescent bulb. The current monitor can be set such that a particular current variance is representative of LED failure. If such a variance is detected, a predetermined response can be initiated such as an alarm trigger to initiate a visual display, contact maintenance personnel, etc.

Alternatively or in addition, a standard pulser circuit can be utilized to superimpose a sinusoidal wave onto the current drawn by a power supply unit. In this manner, the standard pulser circuit can compensate for the disparity in the actual current drawn by the LEDs and the amount detected by a current monitor. The sinusoidal wave output by a standard pulser circuit, however, is an inefficient means to boost the current viewed by the current monitor.

The pulse generator 120 monitors the operating condition of a load (e.g., the LED array 140) in the traffic signal 100 via the amount of current consumed by the load and automatically adjusts its power consumption to maintain a predefined pulse amplitude seen by the current monitor. If a certain number of LEDs draw a certain current value, this value (as well as a surrounding threshold) can be associated with a suitable operation condition.

Current from the PSU 110 is delivered to the LED array 140 to illuminate the plurality of LEDs contained therein. It is to be appreciated that the LED array 140 can contain substantially any number of LEDs in substantially any configuration. In one example, the LED array 140 includes three disparate subsets wherein each subset is a different color. In this manner, one subset can be illuminated to provide a particular indication to regulate traffic. Circuitry can be employed to insure that only a single subset is illuminated at a given point in time.

The control system 130 initiates one more actions based on input received from the PSU 110. The control system 130 can be configured with one or more threshold levels that are associated with particular outputs. In one example, the control system 130 has a high and low threshold that surrounds a predetermined median current value. If the current value is outside of one of these thresholds, an output can be sent to the PSU 110 that indicates a possible lamp failure. It is to be appreciated that multiple alarm levels and associated conditions can be selected to provide appropriate status indications.

Figure 2:
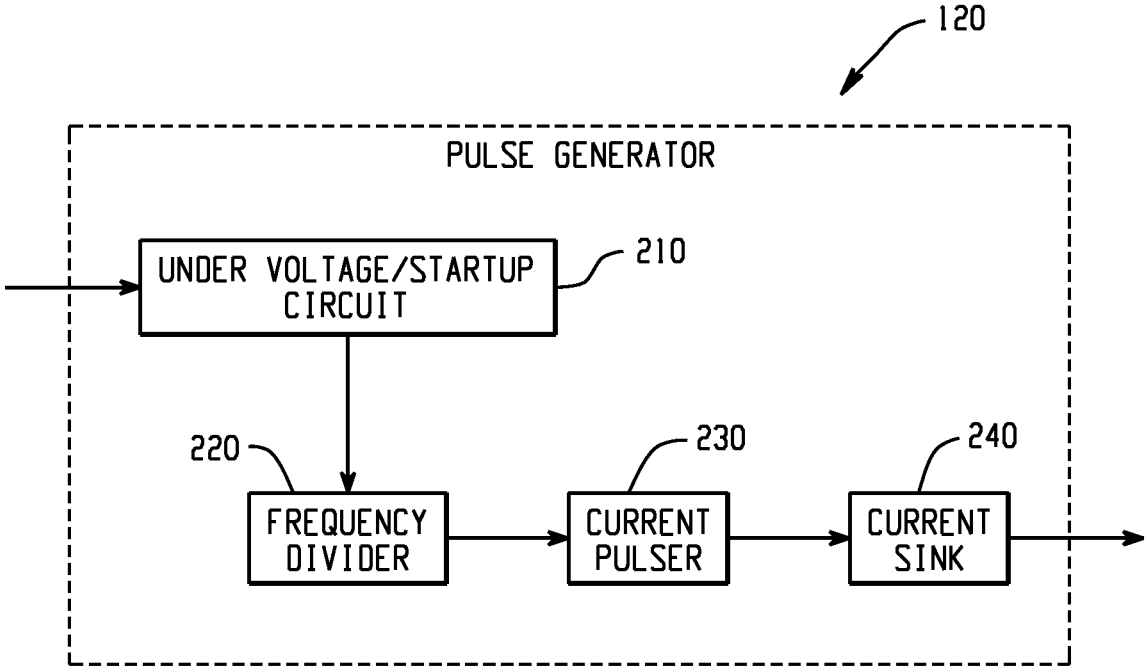
FIG. 2 illustrates a pulse generator employed with a traffic signal that superimposes a shaped pulse onto a lamp current signal, in accordance with an aspect of the subject invention.

FIG. 2 illustrates a more detailed view of the pulse generator 120. The pulse generator 120 includes four components that monitor power consumption within the traffic signal 100: an under voltage/start-up circuit 210, a frequency divider circuit 220, a current pulser circuit 230, and a current sink circuit 240. In one example, the under voltage circuit 210 consists of a peak detector and voltage comparators with hysteresis of about 1.5V for monitoring the line voltage. When the line voltage falls below a predetermined threshold, the clock of the frequency divider circuit 220 will be disabled. Accordingly, the current pulser 230 and the current sink circuit 240 will be turned off.

The start-up circuit 210 provides power for all the other circuits at startup. The under voltage/startup circuit 210 exist on both the PSU 110 and the current pulser 230 for synchronization purposes. The frequency divider circuit 220 consists of a voltage divider network and a decade counter. A clock is provided to the decade counter by an external line frequency (e.g., 50 Hz, 60 Hz, etc.). The decade counter divides the line frequency down to a fraction of the line frequency (e.g., 6 Hz) and feeds the signal to the current pulser circuit 230.

The current pulser circuit 230 is employed to generate non-sinusoidal pulses that are superimposed on the PSU 110 input current. These non-sinusoidal pulses can be shaped in substantially any manner to provide an efficient means to simulate the load of one or more incandescent bulbs. In one example, the shaped pulser circuit 230 outputs a square pulse at a particular current level for a specific period of time. In this manner, the pulse generator 120 can be prevented from detecting a loss of a traffic lamp signal over a voltage range (e.g., between 95 and 135 volts rms).

The current level and frequency of the signal output by the current pulser 230 can be related to substantially any metric, such as the frequency of the external line power, number of LEDs, color of LEDs, additional traffic signal circuitry employed, size of a dummy load, configuration of the pulse generator 120, configuration of the control system 130, etc. In one example, a pulse is generated once every Nth cycle of the external line input, where N is an integer greater than or equal to one. In one aspect, the value of N is related to the frequency of the external line voltage received by the PSU 110.

In one example, the current pulser 230 is designed to meet one or more specifications promulgated by a government entity, such as a state's department of transportation. In one approach, the current pulser 230 utilizes a square regulated current wave. The circuitry of the pulser is on a separate PCB and is connected to the PSU 110 by a cable harness. The current pulser 230 can be designed to be utilized with one or more particular current monitors. The current pulser 230 provides advantages over conventional designs since no microprocessor is required and the characteristics of the square wave are consistent.

The current pulser 230 consists of a window comparator (not shown) and a non-inverting amplifier (not shown) with open loop gain to control the power to a transistor (not shown). The window comparator regulates the pulse width and the inverting amplifier regulates the pulse amplitude. In one embodiment, the window comparator can be set to a pulse width of about 3 ms to feed an amplifier. In a more specific example, the amplifier together with the voltage reference value can drive the transistor and regulate the output to about 500 mA for 3 ms. Generated current pulses can be evenly spaced, with the first pulse generated within 100 ms after the application of AC power. It is to be appreciated that the shape, duration and amplitude of the shaped pulse can be substantially any value to accommodate various disparate design requirements.

The current sink circuit 240 consists of a plurality of power resistors. During the time (e.g., 3 ms) that the current pulser 230 transistor conducts, the current sink circuit 240 superimposes its current pulse to the lamp current and will maintain a total current of about 500 mA. This current regulation can be done through the reference voltage on the non-inverting input, the feedback loop on the inverting input of the amplifier and a power resistor. The lamp current and shaped current pulses are synchronized by the under voltage detection circuit 210. When the input line voltage rises above the under voltage predetermined threshold, the clock input to the non-inverting amplifier is released and the frequency divider circuit begins to operate. In one example, a current pulse is produced once every tenth cycle on the line input, to provide a specific desired frequency (e.g., 6 Hz). The combined lamp current signal and shaped current pulse signal is output from the current sink 240 to the alternating current line.

Figure 3:
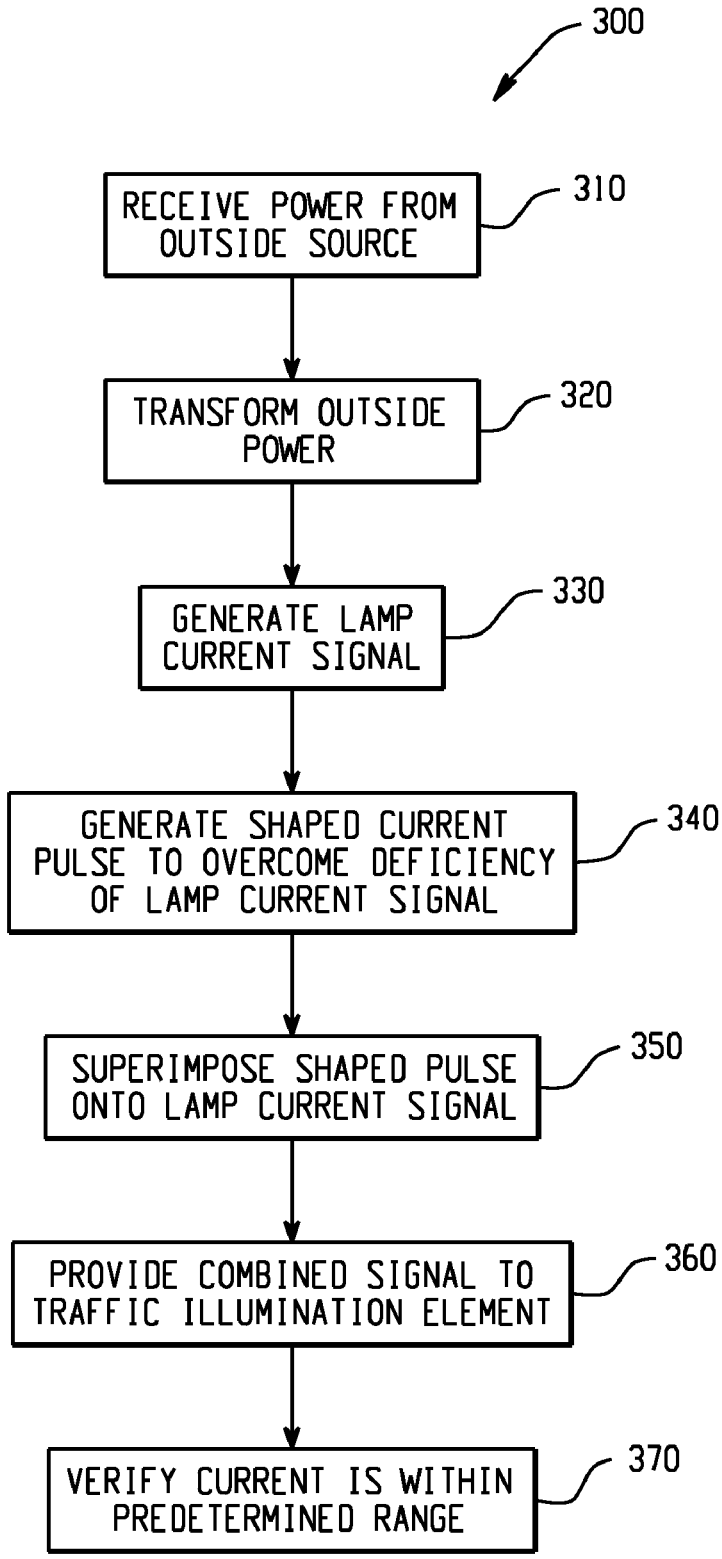
FIG. 3 illustrates a method for generating and superimposing a current pulse onto a lamp current within a traffic signal, in accordance with an aspect of the subject invention.

FIG. 3 illustrates a method 300 to modify power delivered to a traffic signal illumination element such that it is within a predetermined range. At 310, power is received from an outside source. Generally, the source is a grid from a municipality that transmits electricity at a standard voltage and frequency. For example, in the United States the standard voltage and frequency is 110 VAC at 60 Hz. It is to be appreciated that the traffic signal can accept substantially any standard electric voltage and frequency from an outside source.

At 320, the power received from an outside source is transformed from a standard voltage and frequency to a form that is consumable by one or more traffic signal components. In one approach, the power is transformed via a switching power supply that increases the frequency of an alternating current signal to convert it to a substantially direct current signal. In addition, the amplitude of the power can be decreased to a range that is more suitable for commercial components. This conversion can be employed to provide power to solid state illumination elements, such as LEDs for example.

Once the appropriate current level and frequency have been determined, at 330, a lamp current is generated. The lamp current can be generated based upon one or more traffic signal parameters such as number of elements, color of elements, additional circuitry employed, size of a dummy load, etc. In this manner, an appropriate amount of current can be provided to the illumination within the traffic signal.

At 340, a shaped current pulse is generated based at least in part upon the level and frequency of the lamp current pulse. The shaped current pulse can be substantially any non-sinusoidal signal that efficiently complements the value of the lamp current pulse. An artificial intelligence component (not shown) can be employed to provide an appropriate set of parameters for the shaped current pulse. In this manner, the expected amplitude, frequency, etc. of the lamp current pulse can be determined based on the various power consuming components contained in the traffic signal. This lamp current pulse can then be compared to a desired threshold window to determine the appropriate parameters for the shaped current pulse.

The shape of the wave generated can be selected to reduce power consumption while maintaining a power level that is within a predetermined threshold. In this manner, two goals are satisfied to facilitate the replacement of high power illumination elements (e.g., incandescent bulbs) with lower power illumination elements (e.g., LEDs) in traffic signals. First, a current monitoring system does not initiate false alarms based on lower than expected power consumption. This is because the current pulses are provided to complement the actual power consumption to meet a predetermined threshold. Second, the current pulses are generated in a shape that greatly reduces the power consumption of the traffic signal. In general, a pulse shape (e.g., square) is selected that provides an effective but efficient power boost to complement a lamp current signal.

At 350, the shaped (e.g., square) pulse is superimposed onto the lamp current signal. The superimposition of the shaped pulse onto the lamp current signal can be accomplished via a synchronization circuit. In one approach, the lamp current signal and shaped current pulses are synchronized by an under voltage detection circuit 210. When the lamp current signal voltage rises above an under voltage predetermined threshold, a clock input to a non-inverting amplifier is released and a frequency divider circuit begins to operate. In this manner, the peak value of the pulse and the lamp current signal are matched to insure a minimal pulse value increases the total current to a desirable level.

At 360, the combined lamp current signal and shaped current pulse is provided to the current monitoring system. At 370, the amount of current drawn by the LEDs is monitored to insure that the current drawn by the pulse generator and the combined current is within a predetermined range. This monitoring can be performed on periodically, based on event, and/or on a continuous basis. If the current drawn by the LED is outside a predetermined range, it can be indicative of an illumination element failure and an action can be initiated.

Figure 4:
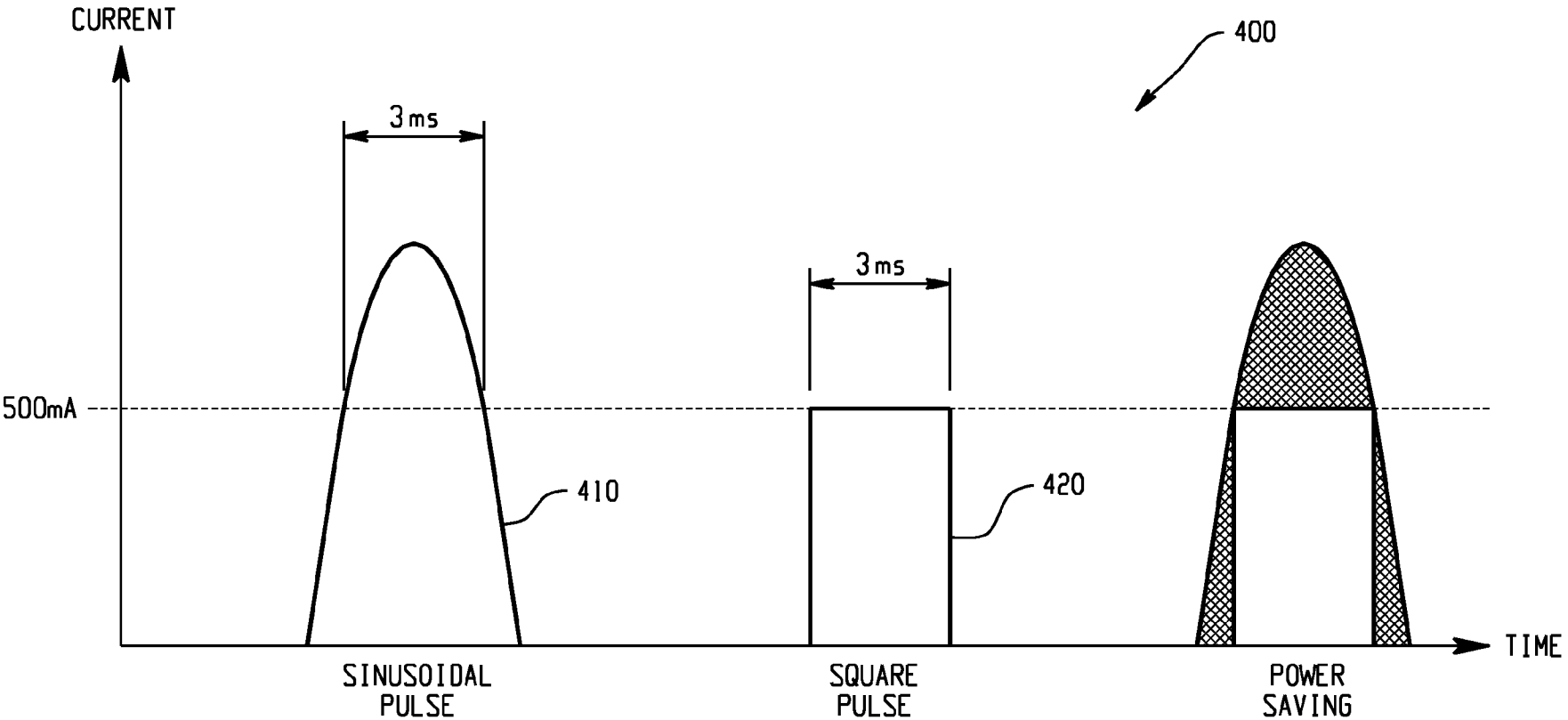
FIG. 4 illustrates the difference in power consumption between a sinusoidal pulse and a square pulse, in accordance with an aspect of the subject invention.

FIG. 4 illustrates a current vs. time chart 400 that includes a sinusoidal pulse 410 and a shaped square pulse 420. Both the sinusoidal pulse 410 and the square pulse 420 have a value equal to or greater than 500 mA for a period of 3 ms. However, as illustrated, the amount of power consumed by the square pulse 420 is significantly less than the power consumed by the sinusoidal pulse 410. The precise amount of power saving can be easily calculated utilizing well known mathematical operations and will not be discussed herein. It is to be appreciated that other shaped current pulses such as clipped sinusoids, triangular formations and the like can be employed to save power.

Figure 5A:
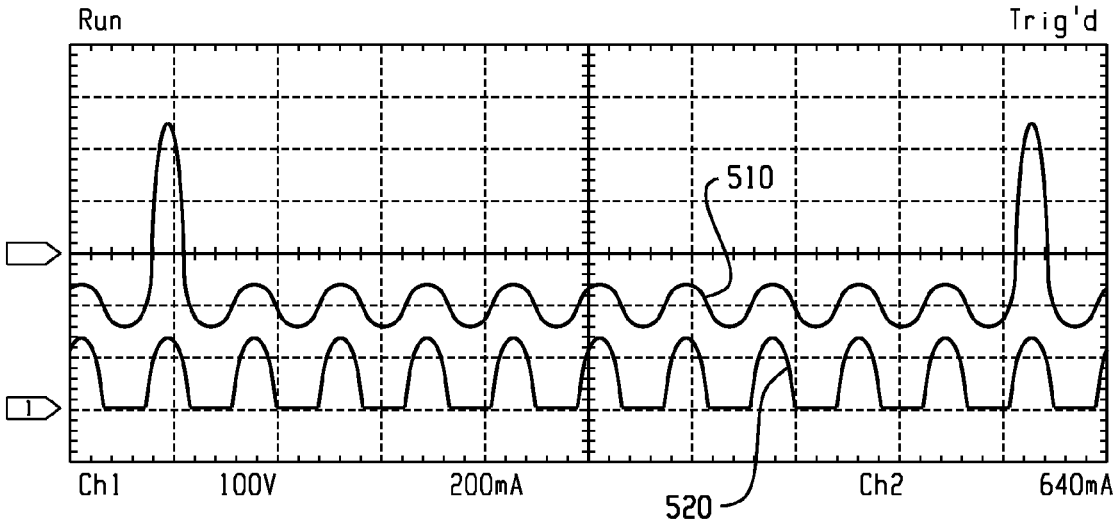
FIG. 5A illustrates a sinusoidal pulse signal and a lamp current signal, in accordance with an aspect of the subject invention.
Figure 5B:
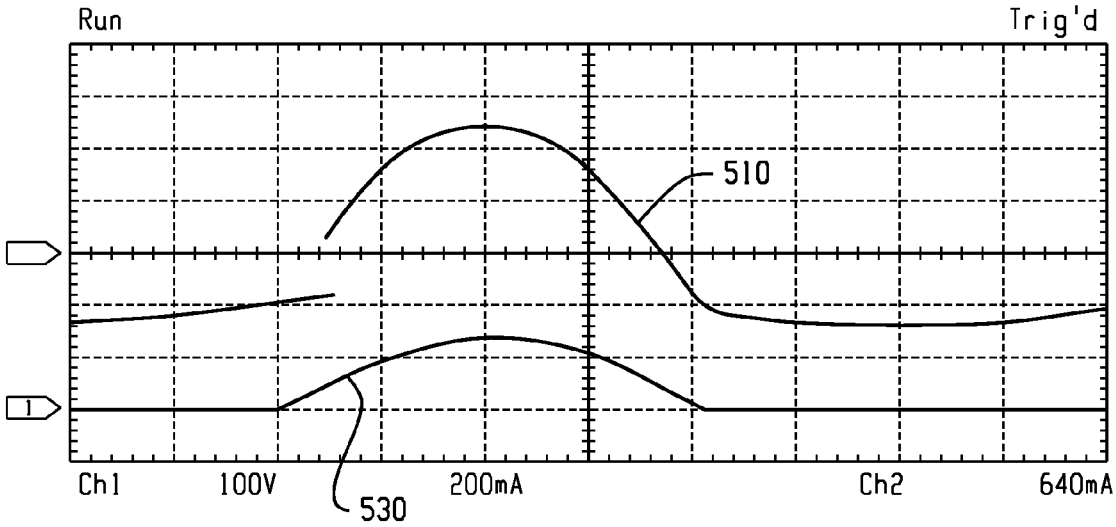
FIG. 5B illustrates a sinusoidal pulse signal and the combined pulse signal and lamp current signal, in accordance with an aspect of the subject invention.
Figure 6A:
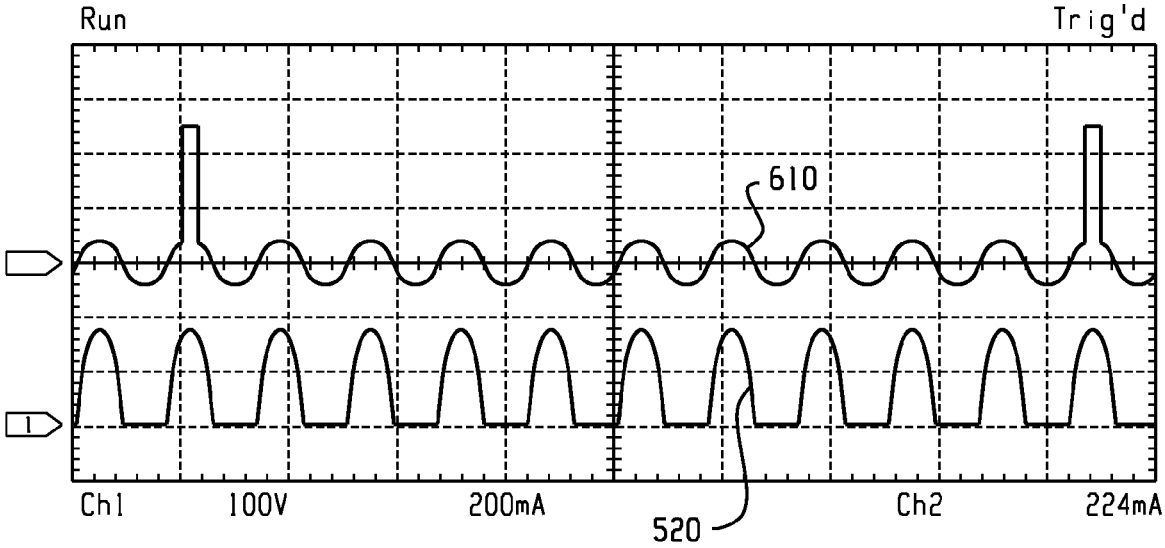
FIG. 6A illustrates a square pulse signal and a lamp current signal, in accordance with an aspect of the subject invention.
Figure 6B:
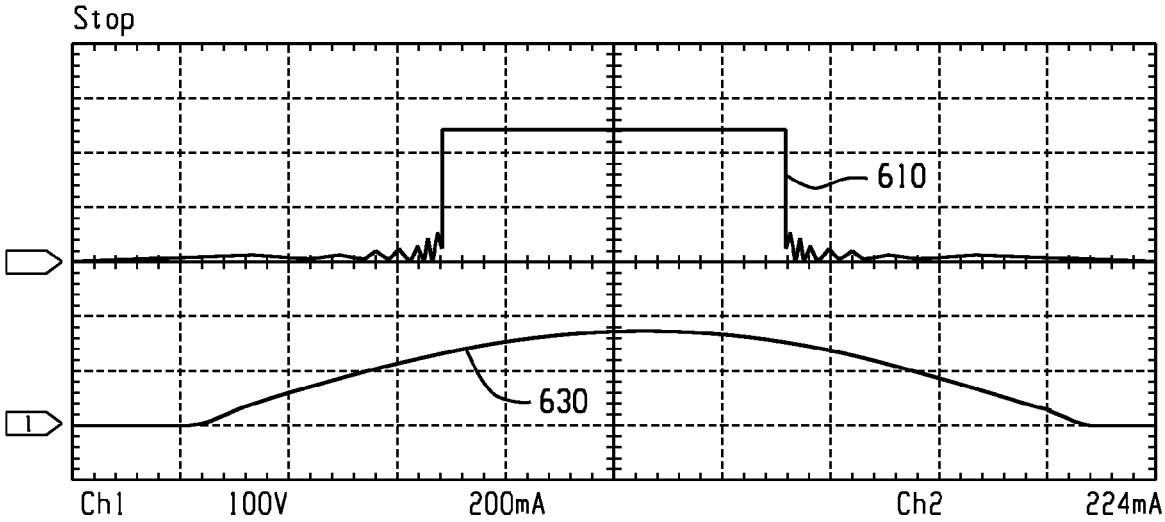
FIG. 6B illustrates a square pulse signal and a substantially similar combined pulse and lamp current signal, in accordance with an aspect of the subject invention.

FIG. 5A illustrates a conventional sinusoidal pulse signal 510 that is superimposed on a lamp current signal 520 to create a combination signal 530. FIG. 5B shows the sinusoidal pulse signal 530 and the relative value of the combined signal. Similarly, FIG. 6A illustrates a square pulse signal 610 that is superimposed on the lamp current signal 520 to create a combination signal 630. As shown in FIG. 6B, the combined signal 630 has the same value as the combined signal 530. Thus, the same result is achieved when using a low power square pulse signal and a high power sinusoidal pulse signal.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A system that creates a desired current level within a traffic signal, comprising:

a power supply unit that receives an external power signal and transforms the power signal to a lamp current;

a pulse generator that generates current pulses and superimposes them onto the lamp current, wherein the pulse generator includes, an under voltage circuit that includes a peak detector and one or more voltage comparators for monitoring the lamp current signal to determine if the voltage of the lamp current signal is below a predetermined threshold;

a frequency divider that consists of a voltage divider network and a counter which divides a clock value and outputs a counter signal, the clock value is the frequency of the lamp current signal;

a current pulser that generates rectangular current pulses at a frequency based at least in part on the decade counter signal;

a current sink that superimposes the square current pulse onto the lamp current and outputs a combined power signal to the alternating current (AC) line; and wherein the clock of the frequency divider circuit, the current pulser and the current sink are disabled when the line voltage is below a predetermined threshold.

2. The system according to claim 1, further including:

a startup circuit that provides power for components within the traffic signal at substantially the same time when the external power signal is received.

3. The system according to claim 1, wherein the power supply unit is a switching power supply.

4. The system according to claim 1, wherein the non-incandescent illumination element is one or more LEDs.

5. The system according to claim 1, wherein the pulses generated are based at least in part upon one or more of the amplitude of the lamp current, the size of a dummy load, frequency of the external line power, color of the non-incandescent element, and number of power consuming components within the traffic signal.

6. The system according to claim 1, wherein the pulses are generated at a predetermined time and at a predetermined amplitude.

7. The system according to claim 1, wherein the pulses are generated at about 500 mA for about 3 ms.

8. The system according to claim 1, further including:

a control component that initiates a predetermined action based at least in part upon the value of the lamp current.

9. A pulse generator system that superimposes a current pulse onto a lamp current signal within a non-incandescent traffic signal, comprising:

an under voltage circuit that receives an input voltage from a power supply unit, the under voltage circuit includes a peak detector and one or more voltage comparators to monitor the external power signal to determine if the voltage of the lamp current signal is below a predetermined threshold;

a frequency divider, comprising, a voltage divider network that lower the threshold of the line voltage to provide a clock value, wherein the clock value is the frequency of the line voltage;

a counter that receives the clock value from the voltage divider network and outputs a counter signal, which is one tenth of the frequency of the clock value;

a current pulser that generates rectangular current pulses at a frequency based at least in part on the decade counter signal, and a current sink that superimposes the rectangular current pulse onto the lamp current signal and outputs a combined power signal;

wherein the line voltage and the current pulses are synchronized by the under voltage detection circuitry, when the lamp current signal voltage rises above the under voltage predetermined threshold, the clock input is released and the frequency divider circuit begins to operate.

10. The system according to claim 9, wherein the current pulser further includes:

a window comparator that sets the width of the pulses, and a non-inverting amplifier that sets the amplitude of the pulses.

11. The system according to claim 9, wherein the current pulses are generated based on a percentage of a frequency of the line voltage.

12. The system according to claim 11, wherein the pulses are generated about every tenth cycle relative to the frequency of the lamp current signal.

13. The system according to claim 9, wherein the clock of the frequency divider circuit, the current pulser and the current sink are disabled when the line voltage is below a predetermined threshold.

14. The system according to claim 9, wherein the current pulser consists of a window comparator and a non-inverting amplifier with an open loop gain to control the power to a transistor, the amplifier is connected to a voltage reference value to drive the transistor and regulate the width and amplitude of the current pulses.

15. The system according to claim 9, wherein there is a delay of no greater than 100 ms to generate a square current pulse after the external power signal is received.

16. The system according to claim 9, wherein the pulse generator generates current pulses over a predetermined voltage range.

17. The system according to claim 16, wherein the voltage range is between about 95 volts rms and 135 volts rms.

18. The system according to claim 9, wherein the voltage comparators have a hysteresis of about 1.5V.

19. A method to modify power delivered to an LED traffic signal illumination element, comprising:

receiving alternating current (AC) power signal from an external source;

transforming the AC power signal to a direct current (DC) signal;

generating a lamp current from the DC signal to power to an LED illumination element;

generating a rectangular current pulse at a predefined time and for a predefined interval;

superimposing the rectangular current pulse onto the lamp current to create a combined current signal; and sending the combined current signal to the alternating current power line.

20. The method according to claim 19, further including:

synchronizing the lamp current and the square current pulse, wherein a current pulse is generated at a fraction of the external AC power signal frequency once the external AC power signal frequency is greater than a predetermined threshold.

* * * * *